US006294791B1

(12) United States Patent
Williams et al.

(10) Patent No.: US 6,294,791 B1
(45) Date of Patent: Sep. 25, 2001

(54) ARTICLE IRRADIATION SYSTEM HAVING INTERMEDIATE WALL OF RADIATION SHIELDING MATERIAL WITHIN LOOP OF A CONVEYOR SYSTEM THAT TRANSPORTS THE ARTICLES

(75) Inventors: Colin Brian Williams, La Jolla; John Thomas Allen; George Michael Sullivan, Jr., both of San Diego, all of CA (US)

(73) Assignee: The Titan Corporation, San Diego, CA (US)

( * ) Notice: Subject to any disclaimer, the term of this patent is extended or adjusted under 35 U.S.C. 154(b) by 0 days.

(21) Appl. No.: 09/305,726

(22) Filed: May 5, 1999

Related U.S. Application Data

(63) Continuation-in-part of application No. 09/102,942, filed on Jun. 23, 1998, now Pat. No. 6,127,687.

(51) Int. Cl.[7] ..... G21F 7/005

(52) U.S. Cl. ..... 250/455.11; 250/453.11; 378/69

(58) Field of Search ..... 250/455.11, 453.11; 378/69

(56) References Cited

U.S. PATENT DOCUMENTS 4,852,138 * 7/1989 Bergeret et al. ..... 250/453.11
5,396,074 * 3/1995 Peck et al. ..... 250/453.11
6,127,687 * 10/2000 Williams et al. ..... 250/492.3

* cited by examiner

*Primary Examiner*—Jack Berman
(74) *Attorney, Agent, or Firm*—Ellsworth R. Roston; Fulwider Patton, et al.

(57) ABSTRACT

An article irradiation system includes (1) a radiation source for scanning a target region with radiation, (2) a conveyor system including a process conveyor positioned for transporting articles in a given direction through the target region, and (3) radiation shielding material defining the walls of a chamber containing the radiation source, the target region and a position of the conveyor system. The radiation source is disposed inside a loop defined by a portion of the conveyor system and is adapted to scan the articles in the chamber in a plane transverse to the given direction of the transport by the process conveyor. A shield (e.g., an intermediate wall) of radiation shielding material positioned within the loop supports a radiation shielding ceiling of the chamber, inhibits photons emitted from a beam stop in one of the chamber walls from impinging on the outer walls of the chamber and restricts flow in the chamber of ozone derived in the target region from the radiation source. A first queue is disposed outside of the chamber for transferring into the chamber articles from a loading area; a second queue is disposed in the chamber for moving the articles past the radiation source for irradiation by the source; and a third queue is disposed in the chamber for transferring articles from the chamber, after irradiation, for movement to an unloading area The operations of the first, second and third queues are synchronized. The shield inhibits radiation from the source from reaching the queues.

37 Claims, 2 Drawing Sheets

ARTICLE IRRADIATION SYSTEM HAVING INTERMEDIATE WALL OF RADIATION SHIELDING MATERIAL WITHIN LOOP OF A CONVEYOR SYSTEM THAT TRANSPORTS THE ARTICLES

This is a continuation-in-part of application Ser. No. 09/102,942 filed in the United States Patent Office on Jun. 23, 1998 for ARTICLE IRRADIATION SYSTEM HAVING INTERMEDIATE WALL OF RADIATION SHIELDING MATERIAL WITHIN LOOP OF A CONVEYOR SYSTEM THAT TRANSPORTS THE ARTICLES, now U.S. Pat. No. 6,127,687, and assigned to the assignee of record of this application.

BACKGROUND OF THE INVENTION

This invention relates to irradiation systems which utilize a conveyor system for transporting articles in a chamber through a target region scanned by radiation from a radiation source. The invention is particularly related (1) to a system for synchronizing the movements of queues providing for the movements of the articles into the chamber, past the radiation source for irradiation of the articles and then from the chamber after the irradiation of the articles and (2) to the disposition of a shield in the chamber for inhibiting radiation from reaching the queues and the walls of the invention.

Co-pending application Ser. No. 09/102,942 by John Thomas Allen et al. on Jun. 23, 1998, and assigned of record to the assignee of record of this application discloses and claims an article irradiation system which includes (1) a radiation source for scanning a target region with radiation, (2) a conveyor system including a process conveyor positioned for transporting articles in a given direction through the target region and (3) radiation shielding material defining the walls of a chamber containing the radiation source, the target region and a portion of the conveyor system. The radiation source is disposed inside a loop defined by a portion of the conveyor system and is adapted to scan the articles in the chamber in a plane transverse to the given direction of transport by the process conveyor. A shield (e.g., an intermediate wall) of radiation shielding materials positioned within the loop supports a radiation shielding ceiling of the chamber, inhibits photons emitted from a beam stop in one of the chamber walls from impinging on other walls of the chamber and restricts flow in the chamber of ozone derived in the target region from the radiation source.

BRIEF DESCRIPTION OF THE INVENTION

In one embodiment of the invention, an article irradiation system includes (1) a radiation source for scanning a target region with radiation, (2) a conveyor system including a process conveyor positioned for transporting articles in a given direction through the target region, and (3) radiation shielding material defining the walls of a chamber containing the radiation source, the target region and a position of the conveyor system. The radiation source is disposed inside a loop defined by a portion of the conveyor system and is adapted to scan the articles in the chamber in a plane transverse to the given direction of the transport by the process conveyor. A shield (e.g., an intermediate wall) of radiation shielding material positioned within the loop supports a radiation shielding ceiling of the chamber, inhibits photons emitted from a beam stop in one of the chamber walls from impinging on the outer walls of the chamber and restricts flow in the chamber of ozone derived in the target region from the radiation source.

A first queue is disposed outside of the chamber for transferring into the chamber articles from a loading area; a second queue is disposed in the chamber for moving the articles past the radiation source for irradiation by the source; and a third queue is disposed in the chamber for transferring articles from the chamber, after irradiation, for movement to an unloading area. The operations of the first, second and third queues are synchronized. The shield inhibits radiation from the source from reaching the queues.

DETAILED DESCRIPTION OF THE INVENTION

Figure 1:
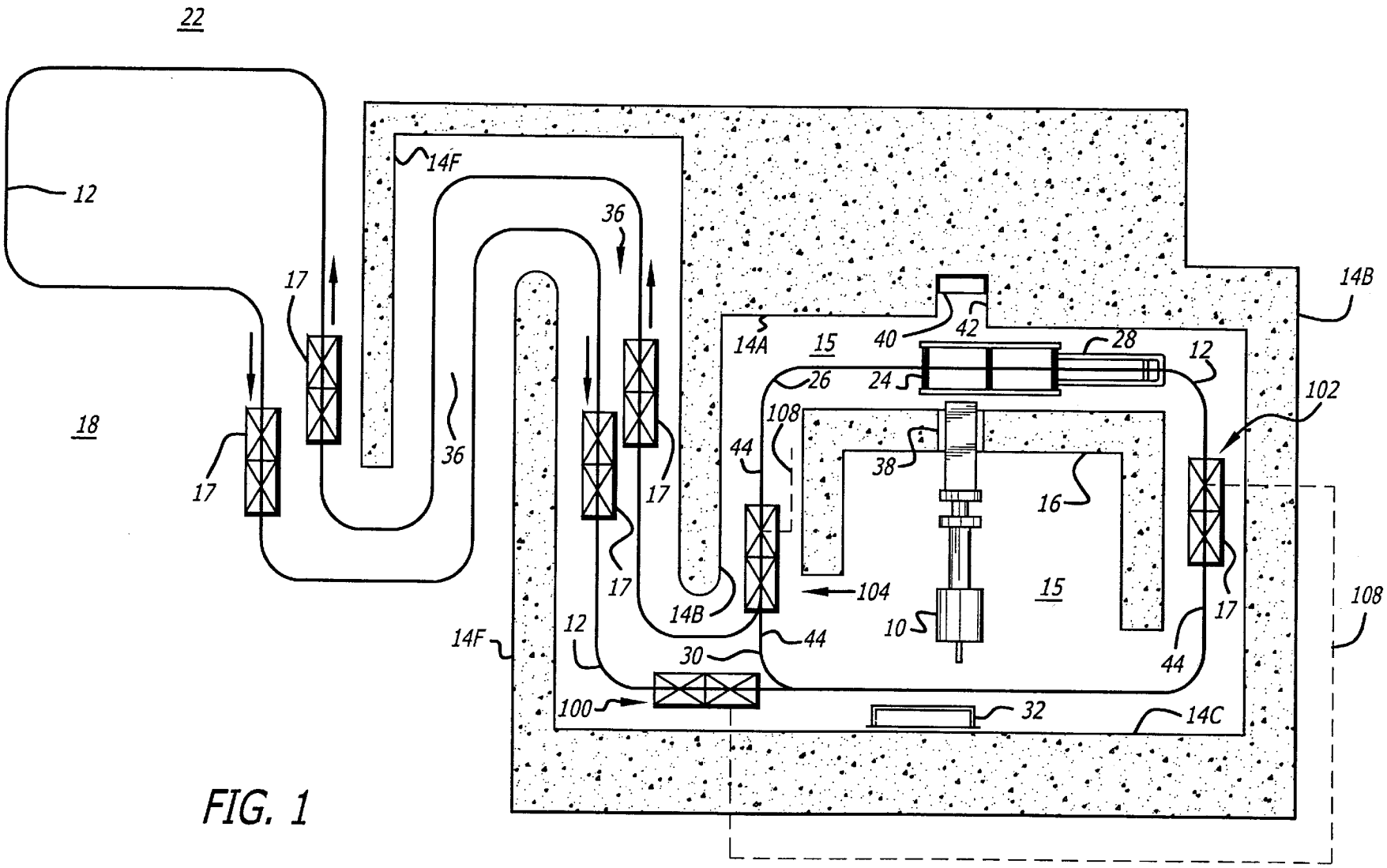
FIG. 1 is a schematic top plan view of a preferred embodiment of an irradiation system according to the invention.
Figure 2:
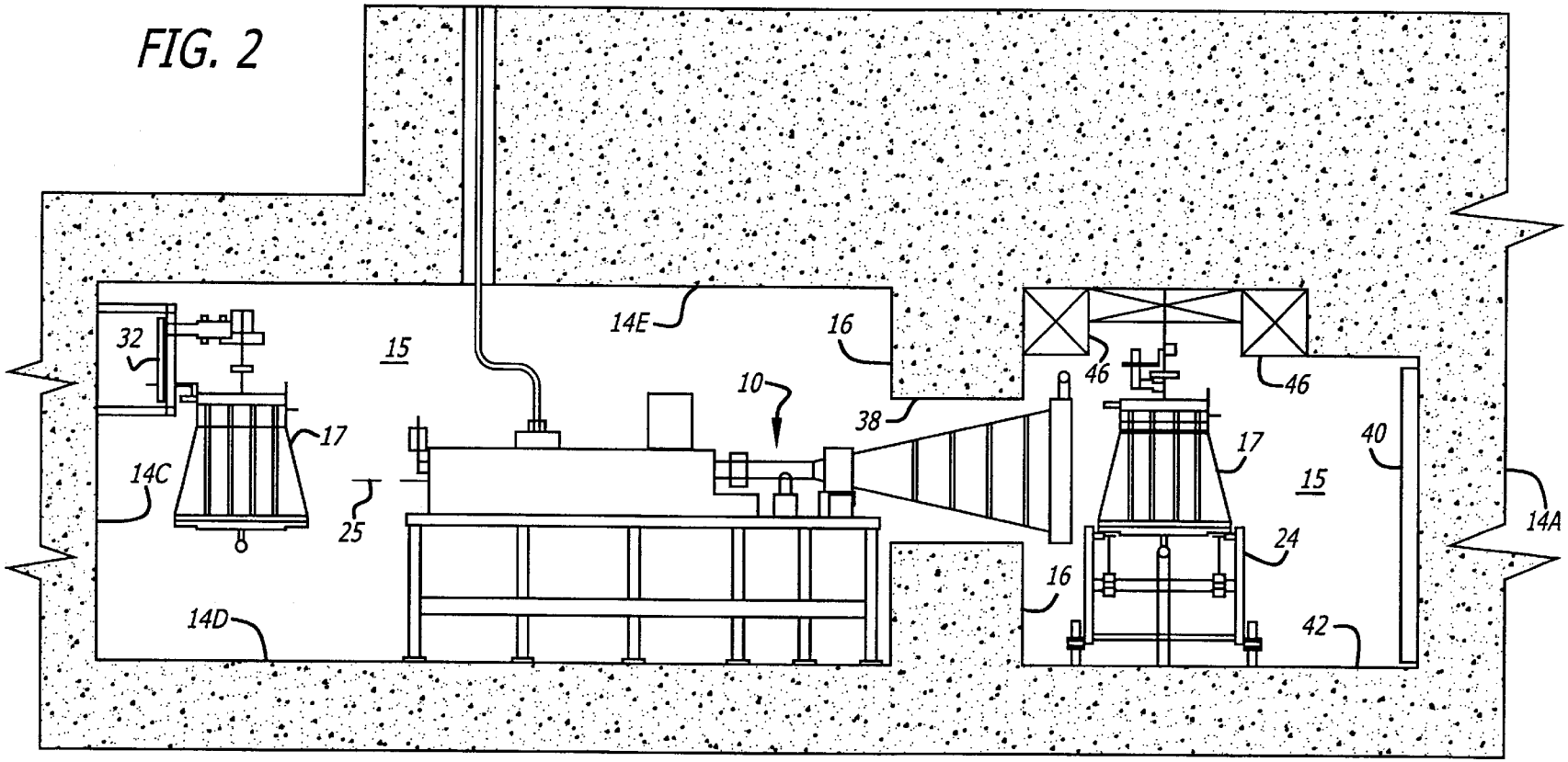
FIG. 2 is a schematic sectional view of a portion of the irradiation system of FIG. 1 as taken along line 2—2 and further showing article carries in positions other than as shown in FIG. 1.

Referring to FIGS. 1 and 2, a preferred embodiment of an irradiation system according to the present invention includes a radiation source 10, a conveyor system 12, radiation shielding material 14 defining a chamber 15 and an intermediate wall 16 of radiation shielding material. Articles carried by article carriers 17 are transported by the convey system 12 in a direction indicated by the arrows from a loading area 18 through a target region 20 to an unloading area 22. The conveyor system 12 includes a process conveyor 24 for transporting articles carried by the article carriers 17 in a given direction through the target region 20.

The radiation source 10 preferably is a 10-million-electron-volt linear accelerator having an electron accelerating wave guide that provides an electron beam for irradiating articles transported through the target region 20 by the conveyor system 12. The radiation source 10 is disposed along an approximately horizontal axis 25 inside a loop 26 defined by a portion of the conveyor system 12 and is adapted for scanning the articles being transported through the target region 20 with an electron beam at a given rate in a plane perpendicular to the given direction of transport by the conveyor system 12. The scanning height and the current of the electron beam are adjusted in accordance with the height and radiation absorption characteristics of the articles being scanned. The scanning of the articles by the electron beam is further controlled as described in the above-referenced U.S. Pat. No. 5,396,074. The accelerator is located inside a removable shield and protected from ionizing radiation and ozone by interior walls. In alternative embodiments, the radiation source scans the articles with a type of radiation other than an electron beam, such as X-rays.

The conveyor system 12 includes a power-and-free conveyor throughout and, in addition to the process conveyor 24, further includes a load conveyor 28, all three of which are independently powered. The power-and-free-conveyor functions as a transport conveyor for transporting the article carriers 17 at a first given speed from the process conveyor 24 through the unloading area 22 and the loading area 18 to the load conveyor 28. The process conveyor 24 transports the articles carriers 17 through the target region 20 at a second given speed that is different than the first given speed at which the article carriers 17 are transported by the transport conveyor. The load conveyor 28 transports the article carriers 17 from the transport conveyor to the process conveyor 24 at a speed that is varied during such transport in such a manner that when the article carriers 17 are positioned on the process conveyor 24 there is a predetermined separation distance between adjacent positioned articles carriers 17. When an article carriers 17 is positioned on the process conveyor 24, the load conveyor 28 is transporting the article carriers 17 at the speed of the processor conveyor 24. Such a conveyor system 12 and the operation thereof is described in detail in the above-referenced U.S. Pat. No. 5,396,074.

In order to reorient articles for retransportation through the target region 20 so that such articles can be irradiated from opposite sides, upon it being detected that an article carrier 17 carrying such articles is so oriented as to have been transported trough the target 20 only once, such article carrier 17 is diverted onto a reroute conveyor section 30 and then transported by the transport conveyor past a mechanism 32 that reorients the so-oriented article carrier 17 by 180 degrees for said retransportation through the target region 20. Such a reorienting mechanism 32 and means for detecting the orientation of an article carrier 17 are also described in U.S. Pat. No. 5,396,074 to Peck et al.

The radiation shielding material 14 includes walls 14A, 14B, 14C, a floor 14D and a ceiling 14E defining the chamber 15 that contains the radiation source 10, the target region 20 and at least the portion of the conveyor system 12 that includes the process conveyor 24, the load conveyor 28 and the adjacent portions of the transport convey. Additional walls 14F of radiation shielding material define an angled passageway 36 into the chamber 15 for the conveyor system 12 and shield the loading area 18 and the unloading area 22, which are located outside of the chamber 15, from radiation derived from the radiation source 10.

The intermediate wall 16 is position within the loop 26 and transverse to the approximately horizontal axis 25 of the radiation source 10. The intermediate wall 16 has an aperture 38 through which the radiation source 10 is disposed.

The ceiling section 14E of the radiation shielding material is supported in part by the intermediate wall 16; whereby the underlying chamber 15 may be of a greater area and/or the ceiling section 14E may be of a greater span and/or of a greater weight than would be permitted in the absence of such support.

Preferably, the radiation shielding material 14A, 14B, 14C, 14D, 14E, 14F (collectively referred to as 14), 16 is primarily concrete because of cost considerations. However, other types of radiation shielding material may be used when spaced is limited or in view of other requirements, such as steel. In alternative embodiments, some of the radiation shielding material may be concrete and some not. For example, in one alternative embodiment shielding material other than concrete, such as steel, selected in accordance with limited space requirements, while the remainder of the radiation shielding material 14 is concrete.

A beam stop 40 is disposed in a recess 42 in the wall 14A of radiation shielding material that is on the opposite side of the target region 20 from the electron beam radiation source 10. The beam stop 40 is made of a material, such as aluminum, that absorbs electrons and converts the energy of the absorbed electrons into photons that are emitted from the beam stop 40. The beam stop 40 is so disposed in the recess 42 that some of the photons emitted from the beam stop 40 toward the radiation source 10 but obliquely thereto are inhibited from entering the chamber 15 by the portion of the radiation shielding material in the wall 14A that defines the recess 42. The recessing of the beam stop 40 reduces the intensity of back scattered photons, thereby decreasing the thickness required for the side walls 14B, the back wall 14C and the ceiling section 14E. This reduces construction costs and shortens the construction schedule.

Sections 44 of the transport conveyor portion of the conveyor system 13 are positioned for transporting the article carries 17 in directions that are transverse to the given direction of transport by the process conveyor 24. The lateral walls 14B of the chamber-defining radiation shielding material are disposed outside the loop 26 adjacent these transversely positioned sections 44 of the conveyor system 12 and portions of the intermediate wall 16 are positioned adjacent these transversely positioned sections 44 of the conveyor system 12 and across from substantial portions of the lateral walls 14A.

The intermediate wall 16 is thereby positioned between the beam stop 40 and the lateral walls 14B so that photons emitted into the chamber 15 from the beam stop 40 are inhibited from impinging upon the lateral walls 14B. The intermediate wall 16 is also positioned between the beam stop 40 and the wall 14C on the opposite side of the chamber 15 from the wall 14A in which the beam stop 40 is recessed so that photon emitted from the chamber 15 from the beam stop are inhibited from impinging upon the opposite wall 14C. As a result, the lateral walls 14B and the opposite wall 14C may be of a lesser thickness of radiation shielding material than would be required in the absence of the intermediate wall 16.

The intermediate wall 16 also is positioned for restricting flow throughout the chamber 15 of ozone derived in the target region 20 from the radiation source 10. Accordingly, most of such ozone can be removed from the chamber 15 b exhaust ducts 46 in the chamber 15 disposed above the target region 20.

The dimensions of the various components of the radiation shielding material 14 and of the intermediate wall of radiation shielding material 16 are determined by computer-aided modeling in accordance with a technique described in a manual entitled "MCNP—A General Monte Carlo Code for Neutron and Photo Transport" published by the Radiation Shielding Information Center, P.O. Box 2008, Oak Ridge, Tenn. 37831.

A plurality of queues respectively indicated generally at 100,102 and 104 are included in the embodiment shown in FIG. 1. Each of the queues may be defined by a plurality of the article carriers 17. The queue 100 is disposed at a position preferably just outside the loop 26 for a transfer into the loop of the articles in the queue. The queue 102 is disposed within the loop at a position for each of the article carriers 17 to be released from the queue and to be moved past the radiation source 10 for an irradiation of the article in the article carrier. The queue 104 is disposed within the loop 26 at a position just inside the loop for a transfer of each of the article carriers 17 out of the loop.

The operations of the queues 100, 102 and 104 are synchronized. In this way, the first one of the article carriers 17 in the queue 100 is transferred into the loop 26 at the same time that the first one of the article carriers in the queue 102 is moved past the radiation source 10. In like manner, the first one of the article carriers 17 in the queue 100 is transferred into the loop 26 at the same time that the first one of the article carriers in the queue 104 is transferred out of the loop. A synchronizer for providing this function is indicated by broken lines 108 extending between the queues 100, 102 and 104.

The intermediate wall 16 is disposed relative to each of the queues 100, 102 and 104 so that it shields the article carriers in the queue from radiation from the source 10. In this way, the articles in the article carriers 17 are not exposed to radiation from the source 10 during the time that the article carriers are disposed in the queues 100, 102 and 104.

In an alternative embodiment, the loop within which the intermediate wall 14B is positioned is not a closed loop, such as shown in FIG. 1, but instead is an open loop, such as would be formed by elimination of the reroute conveyor section 30.

An article irradiation system in accordance with the present invention provides the advantages of: (a) reducing the volume of concrete required in the ceiling section 14E, thereby reducing the cost and complexity of the structure; (b) reducing radiation levels incident on sensitive electrical and mechanical equipment, such as the radiation source 10 and the reorienting mechanism 32, thereby prolonging the life of such equipment; and (c) constraining ozone production to the vicinity of the process conveyor 24, thereby reducing the quantity of ozone produced and its dispersal throughout the chamber 15 so to prolong the life of the equipment and reduce the environmental impact of ozone vented to the atmosphere.

The advantages specifically stated herein do not necessarily apply to every conceivable embodiment of the present invention. Further, such stated advantages of the present invention are only examples and should not be construed as the only advantages of the present invention.

While the above description contains many specificities, these should not be construed as limitations on the scope of the present invention, but rather as examples of the preferred embodiments described herein. Other variations are possible and the scope of the present invention should be determined not by the embodiments described herein but rather by the claims and their legal equivalents.

What is claimed is:

1. An irradiation system for irradiating articles, including, a chamber defined by walls, a radiation source disposed in the chamber and constructed to provide radiation in the chamber, a conveyor system constructed to carry the articles through the chamber for the irradiation of the articles by the radiation source, a first queue for introducing the articles into the chamber, a second queue for moving the articles in the chamber past the radiation source, a third queue for passing the articles from the chamber after the irradiation of the articles by the radiation source, a synchronizer for synchronizing the operation of the first, second and third queues, and a shield disposed in the chamber for shielding the first, second and third queues from irradiation by the radiation source.

2. An irradiation system as set forth in claim 1 including, a photon converter in the chamber for converting the radiation from the source to photons, and the shield being operative to shield the walls of the chamber and the first, second and third queues from the photons by the photon converters.

3. An irradiation system as set forth in claim 1 wherein the radiation source extends through the shielding member and wherein the chamber includes a ceiling and wherein the shield supports the ceiling.

4. An irradiation system as set forth in claim 1 wherein the shield includes an intermediate wall made from a radiation shielding material and wherein the radiation shielding material is separated from the walls of the chamber.

5. An irradiation system as set forth in claim 2 wherein the radiation source extends through the shielding member and wherein the chamber includes a ceiling and wherein the shield supports the ceiling and wherein the shield includes an intermediate wall made from a radiation shielding material and wherein the radiation shielding material is separated from the walls of the chamber.

6. An irradiation system for irradiating articles, including, a loading area, an unloading area, a chamber displaced from the loading area and the unloading area, a radiation source disposed in the chamber for irradiating articles in the chamber, a first queue for transferring the articles from the loading area to the chamber, a second queue for transferring the articles from the chamber to the unloading area in synchronized relationship with the transfer by the first queue of the articles from the loading area to the chamber, a third queue operative in synchronized relationship with the first and second queues for transferring the articles in the chamber to a position for irradiation of the articles by the radiation source in the chamber, and a shield disposed in the chamber for shielding the first, second and third queues from the radiation in the chamber.

7. An irradiation system as set forth in claim 6, including;

the chamber being defined by a plurality of walls and the shield being disposed in the chamber relative to the walls to shield the walls from the radiation from the source.

8. An irradiation system as set forth in claim 7, the shield constituting an intermediate wall disposed in the chamber in spaced relationship to the walls defining the chamber.

9. An irradiation system as set forth in claim 7 wherein the chamber includes a ceiling and wherein the shield is disposed in the chamber to support the ceiling.

10. An irradiation system as set forth in claim 7, including the shield constituting an intermediate wall disposed in the chamber in spaced relationship to the walls defining the chamber, the chamber including a ceiling, the shield being disposed in the chamber to support the ceiling, and the shield and the walls and the ceiling of the chamber being made from a radiation shielding material.

11. An irradiating system for irradiating articles, including, a chamber defined by walls, a radiation source constructed to provide radiation in the chamber, a conveyor system constructed to carry the articles through the chamber for the irradiation of the articles in the chamber by the radiation source, a first queue disposed in the chamber for introducing the articles to the conveyor system, and a second queue disposed in the chamber for operation in synchronism with the operation of the first queue, the second queue being operative to pass the articles from the chamber after the irradiation of the articles by the radiation source, and a shield disposed in the chamber for shielding the first and second queues and the walls of the chamber.

12. An irradiating system as set forth in claim 11 wherein the walls of the chamber and the shield are made from a radiation shielding material.

13. An irradiating system as set forth in claim 12 wherein the shield includes an intermediate wall disposed in the chamber in spaced relationship to the walls defining the chamber.

14. An irradiating system as set forth in claim 11, including, a loading area for holding the articles to be irradiated, means for passing the articles from the loading area into the chamber for obtaining the irradiation of the articles by the radiation source, an unloading area for receiving the articles after the articles have been irradiated, and means for passing the articles to the unloading area after the articles have been irradiated and passed from the chamber.

15. An irradiating system as set forth in claim 14 wherein the walls of the chamber and the shield are made from a radiation shielding material and wherein the shield includes an intermediate wall disposed in the chamber in spaced relationship to the walls defining the chamber and in position relative to the first and second queues and the walls of the chamber to shield the first and second queues and the walls of the chamber.

16. An irradiating system for irradiating articles, including, a chamber defined by walls, a radiation source constructed to provide radiation in the chamber, a conveyor system constructed to carry the articles through the chamber for the irradiation of the articles in the chamber by the radiation source, a loading area displaced from the chamber, a first queue disposed outside of the chamber for introducing the articles into the chamber, a second queue disposed in the chamber and operative in synchronism with the operation of the first queue for introducing the articles in the chamber to the conveyor system, a third queue disposed in the chamber and operative in synchronism with the operation of the first and second queues for passing the articles from the chamber after the irradiation of the articles by the radiation source, and a shield disposed in the chamber relative to the first, second and third queues for shielding the first, second and third queues for radiation from the radiation source.

17. An irradiating system as set forth in claim 16, including, ozone being derived in the chamber from the radiation source, and the shield being disposed in the chamber to restrict the flow of ozone through the chamber.

18. An irradiating system as set forth in claim 16, including;

means for converting radiation in the chamber to photons, the shield being disposed in the chamber to inhibit the photons from impinging on the walls defining the chamber, thereby providing for a reduction in the thickness of the walls defining the chamber.

19. An irradiating system as set forth in claim 16 wherein the radiation source extends through the shield.

20. An irradiating source as set forth in claim 18, including, ozone being derived in the chamber from the radiation source, and the shield being disposed in the chamber to restrict the flow of ozone through the chamber, and the radiation source extending through the shield.

21. An irradiating system for irradiating articles, including, a chamber defined by walls, a radiation source contracted to carry the articles through the chamber for the irradiation of the articles in the chamber by the radiation source, a conveyor system for passing the articles through the chamber for irradiation by the source, a first queue disposed outside the chamber for introducing the articles to the conveyor system, a second queue disposed in the chamber for co-operating with the conveyor system in moving the articles in the chamber past the radiation source for an irradiation of the articles, and a shield disposed in the chamber for shielding the first and second queues and the walls of the chambers.

22. An irradiating system as set forth in claim 21 wherein the walls of the chamber and the shield are made from a radiation shielding material.

23. An irradiating system as set forth in claim 21 wherein the shield includes an intermediate wall disposed in the chamber in spaced relationship to the wall defining the chamber.

24. An irradiating system as set forth in claim 21, including, a loading area for holding the articles to be irradiated, means for passing the articles from the loading area into the chamber for the irradiation of the articles by the radiation source, an unloading area for receiving the articles after the articles have been irradiated, and means for passing the articles to the unloading area after the articles have been irradiated and passed from the chamber.

25. An irradiating system as set forth in claim 24 wherein the walls of the chamber and the shield are made from a radiation shielding material, and the shield includes an intermediate wall disposed in the chamber in spaced relationship to the wall defining the chamber.

26. A method of providing an irradiation of articles, including the steps of:

providing a chamber defined by a plurality of walls, providing a loading area for the articles at a position displaced from the chamber, providing an unloading area for the articles at a position displaced from the chamber, providing a source of radiation in the chamber, providing a conveyor path for the movement of the articles from the loading area through the chamber to the unloading area and for the irradiation of the articles by the source during the movement of the articles through the chamber, providing a first queue in the chamber to provide for a controlled movement of the articles in the chamber past the source of radiation, providing a second queue in the chamber to provide for a controlled movement of the articles from the chamber after the irradiation of the articles by the radiation source, providing for a synchronized operation of the first and second queues, and disposing a shield in the chamber to prevent radiation in the chamber from reaching the first and second queues.

27. A method as set forth in claim 26 wherein the walls defining the chamber and the shield are made from a radiation shielding material and wherein the shield is disposed in the chamber in spaced relationship to the walls defining the chamber.

28. A method as set forth in claim 26 wherein the loading area and the unloading area are disposed in spaced relationship to each other and wherein a third queue is disposed outside of the chamber to transfer into the chamber the articles received from the loading area and wherein the operation of the third queue is synchronized with the operation of the first and second queues.

29. A method as set forth in claim 26 wherein the shield is an intermediate wall disposed in the chamber in spaced relationship to the walls defining the chamber.

30. A method as set forth in claim 26 wherein a beam stop is disposed in the chamber to convert to photons the radiation in the chamber and wherein the shield prevents the photons in the chamber from reaching the queues.

31. An irradiating system as set forth in claim 27 wherein the loading area and the unloading area are disposed in spaced relationship to each other wherein a third queue is disposed outside of the chamber to transfer into the chamber the articles received from the loading area and wherein the operation of the third queue is synchronized with the operation of the first and second queues and wherein the shield is an intermediate wall disposed in the chamber in spaced relationship to the walls defining the chamber wherein a beam stop is disposed in the chamber to convert to photons the radiation in the chamber and wherein the shield prevents the photons in the chamber from reaching the queues.

32. A method of providing an irradiation of articles, including the steps of:

providing a chamber defined by a plurality of walls, providing a loading area of the articles at a position displaced from the chamber, providing an unloading area for the articles at a position displaced from the chamber, providing a source of radiation, providing a first queue at a position outside of the chamber and at a position between the loading area and the chamber, providing a second queue in the chamber near a position for a transfer of the articles past the source of radiation, synchronizing the operation of the first and second queues to provide for a transfer into the chamber of one of the articles to be irradiated and a synchronous transfer of another one of the articles past the source of radiation and disposing a shield in the chamber to inhibit radiation from reaching the first and second queues.

33. A method as set forth in claim 32 wherein the walls of the chamber and the shield are made from a radiation shielding material and wherein the shield is an intermediate wall disposed in the chamber in spaced relationship to the walls of the chamber.

34. A method as set forth in claim 32 wherein the source of radiation extends through the shield in a transverse relationship to the shield and wherein the radiation from the source is directed against a beam stop in the chamber to obtain the production of photons and wherein the shield is disposed in the chamber to inhibit the photons from reaching the walls of the chamber.

35. In a method as set forth in claim 32 wherein ozone is derived in the chamber from the source of radiation and wherein the shield is disposed in the chamber to restrict the flow of ozone from the chamber.

36. A method as set forth in claim 33 wherein the source of radiation extends through the shield in a transverse relationship to the shield and wherein the radiation from the source is directed against a beam stop in the chamber to obtain the production of photons and wherein the shield is disposed in the chamber to inhibit the photons from reaching the walls of the chamber and wherein ozone is derived in the chamber from the source of radiation and wherein the shield is disposed in the chamber to restrict the flow of ozone from the chamber.

37. A method as set forth in claim 36 wherein a third queue is disposed in the chamber to obtain a movement of the articles from the chamber after an irradiation of the articles by the source and wherein the operation of the third queue is synchronized with the operation of the first and second queues.

* * * * *